US009544970B2

(12) United States Patent
Dunser et al.

(10) Patent No.: US 9,544,970 B2
(45) Date of Patent: Jan. 10, 2017

(54) DETECTION OF AN LED MODULE

(71) Applicant: TRIDONIC GMBH & CO KG, Dornbirn (AT)

(72) Inventors: Matthias Dunser, Dornbirn (AT); Jurgen Fink, Lochau (AT); Thomas Ondrisek, Vienna (AT); Klaus Mundle, Feldkirch (AT); Gunter Marent, Bartholomaberg (AT); Andre Mitterbacher, Dornbirn (AT)

(73) Assignee: TRIDONIC GMBH & CO KG, Dornbirn (AT)

( * ) Notice: Subject to any disclaimer, the term of this patent is extended or adjusted under 35 U.S.C. 154(b) by 0 days.

(21) Appl. No.: 14/652,171

(22) PCT Filed: Dec. 20, 2013

(86) PCT No.: PCT/AT2013/000212
§ 371 (c)(1),
(2) Date: Jun. 15, 2015

(87) PCT Pub. No.: WO2014/094016
PCT Pub. Date: Jun. 26, 2014

(65) Prior Publication Data

US 2015/0373811 A1 Dec. 24, 2015

(30) Foreign Application Priority Data

Dec. 21, 2012 (DE) ..... 10 2012 224 141
Nov. 28, 2013 (AT) ..... GM 398/2013

(51) Int. Cl.
*H05B 37/02* (2006.01)
*H05B 33/08* (2006.01)

(52) U.S. Cl.
CPC ..... *H05B 33/0884* (2013.01); *H05B 33/08* (2013.01); *H05B 33/0815* (2013.01); *H05B 33/0848* (2013.01); *H05B 33/0854* (2013.01)

(58) Field of Classification Search
CPC ..... H05B 33/08; H05B 37/02; H05B 41/16
(Continued)

(56) References Cited

U.S. PATENT DOCUMENTS 5,367,227 A * 11/1994 Gademann ..... H05B 41/042 315/205
5,696,670 A * 12/1997 Roederer ..... H02M 1/4258 315/DIG. 7
(Continued)

FOREIGN PATENT DOCUMENTS

DE 102008039530 A1 2/2010
DE 102012008499 A1 10/2013
(Continued)

OTHER PUBLICATIONS

European Search Report mailed Dec. 12, 2014, from Austrian counterpart application GM 446/2013.

*Primary Examiner* — Tung X Le
(74) *Attorney, Agent, or Firm* — Volpe and Koenig, P.C.

(57) ABSTRACT

The invention relates to an LED module (1), comprising: connections (2) for an LED array (3); a circuit (4) which is configured to constitute a load, preferably an effective power load, if during a starting phase a constant current or a constant voltage is applied to the LED module (1), and which is configured not to constitute a load when the starting phase has finished, wherein the circuit (4) is designed to constitute a variable-current load which effects a change in the power consumption of the LED module (1) according to at least one predetermined protocol effected.

16 Claims, 13 Drawing Sheets

(58) Field of Classification Search
USPC ..... 315/291, 294, 297, 299, 307, 312, 360
See application file for complete search history.

(56) References Cited

U.S. PATENT DOCUMENTS

| | | | | |
|---|---|---|---|---|
| 6,445,598 | B1 * | 9/2002 | Yamada | H02M 3/33507 363/21.12 |
| 9,112,426 | B2 * | 8/2015 | Zhu | H02M 1/4258 |
| 2004/0218405 | A1 * | 11/2004 | Yamada | H02M 3/335 363/18 |
| 2011/0080110 | A1 * | 4/2011 | Nuhfer | H05B 33/0815 315/291 |
| 2012/0119662 | A1 | 5/2012 | Radermacher | |

FOREIGN PATENT DOCUMENTS

| | | | |
|---|---|---|---|
| EP | 1244334 | A2 | 9/2002 |
| EP | 1379108 | A1 | 1/2004 |
| EP | 1517588 | A1 | 3/2005 |
| WO | 2010065598 | A2 | 6/2010 |
| WO | 2010091619 | A1 | 8/2010 |
| WO | 2010092504 | A1 | 8/2010 |

* cited by examiner

DETECTION OF AN LED MODULE

FIELD OF THE INVENTION

The present invention relates to an LED module, an LED converter and methods which make it possible to transmit operational parameters of the LED module to the LED converter without a specific communications line between the LED module and the LED converter.

BACKGROUND

Several approaches for presetting operational parameters for a connected LED module to an LED converter are already known from the prior art. This is necessary, for example, since different forward currents are required for different LED modules in order to illuminate the LED strings of the LED modules. Operational parameters are, for example, a required forward current or a setpoint or forward voltage to be applied.

One approach known from the prior art is to set the operational parameters to be set for the connected LED module at the LED converter via dip switches or resistors. Interaction with the LEO converter is required for this, however.

In another approach, configuration resistors are used on the LED module in order to preset the required operational parameters to the LED converter. For this purpose, however, firstly additional connections are required, and secondly interaction is again necessary.

It is also known to transmit the required operational parameters to the LED converter via a separate digital signal channel. However, additional components need to be installed for this and again interaction is required.

Finally, it is also known to assign an EPROM to the LED module, for example, from which the LED converter can determine information regarding the operational parameters to be set at the LED module.

The approaches known from the prior art all either require interaction with the LED converter or the LED module or require additional connections or components, however. As a result, the costs of the LED module and/or the LED converter are increased. In addition, more space is required for the components, which prevents a more compact design.

The object of the present invention consists in improving the known prior art, particularly as regards the abovementioned disadvantages. In particular, the object of the present invention consists in transmitting (reporting back) information regarding operational parameters of an LED module, for example, to an LED converter, without additional component parts or connections or interaction being necessary. It is therefore an object of the present invention to produce an LED module and an LED converter at less cost and to provide them with a more compact design.

The objects of the present invention are achieved by the features of the independent claims. The dependent claims develop the core concept of the invention in an advantageous manner.

SUMMARY

The invention relates to a system in which information can be transmitted to the LED converter owing to a generated load or load changes in the LED module. For example, in accordance with the present invention, information can be transmitted to the LED converter owing to a generated load or load changes in the LED module in a preferably temporally limited starting phase. Alternatively or in addition, in accordance with the present invention, information can be exchanged between the LED converter and the LED module by means of bidirectional communication, wherein preferably the communication is transmitted from the LED module by a generated load or load changes in the LED module.

In one embodiment, the present invention makes use of the fact that, in order to operate an LED module, in particular in order to illuminate an LED string of the LED module, a specific forward voltage across the LED string, i.e. a specific supply voltage across the LED module, is required. Below the forward voltage, the LED string is off. The LED string is therefore non-conducting and represents a virtually infinite resistance for the LED converter. Only at or above the forward voltage does the LED string represent a real power load for the LED converter. A supply voltage across an LED string which is unequal to zero but is below the forward voltage defines a voltage window in which the LED string is not yet conducting. This voltage window is used by the present invention in order to transmit information to the LED converter owing to a generated load or load changes in the LED module.

For example, the present invention relates to an LED module, which comprises: connections for an LED string, a circuit which is designed to represent a load, preferably a real power load, when a first supply voltage unequal to zero is present at the LED module at which a connected LED string is non-conducting, and which is designed to represent no load when a second supply voltage unequal to zero is present at the LED module, in which a connected LED string is conducting. The load for the voltage window (readout window) in which the LED string is non-conducting effects a power consumption of the LED module.

For example, in a preferably temporally limited starting phase, a circuit which is designed to represent a load, preferably a real power load, can be activated. Once the preferably temporally limited starting phase has elapsed, the circuit can be designed to represent no load. The load for the preferably temporally limited starting phase effects a power consumption of the LED module.

The invention also relates to an LED module, which has connections for an LED string, and a circuit, which is designed to represent a load, preferably a real power load, when a constant current or a constant voltage is applied to the LED module in a starting phase, and which is designed to represent no load when the starting phase has elapsed, wherein the circuit is configured to represent a variable-current load, which effects a change in the power consumption of the LED module in accordance with at least one preset protocol.

For example, the present invention relates to an LED module, which comprises: connections for an LED string, a circuit which is designed to represent a load, preferably a real power load, when a first supply current unequal to zero is supplied to the LED module, and which is designed to represent no load when a second supply current unequal to the first supply current is supplied to the LED module or when a preferably temporally limited starting phase has elapsed. The load for the voltage window (readout window) in which the LED string is non-conducting effects a power consumption of the LED module.

An LED converter can identify this power consumption and can determine parameters of the LED module on the basis of the identified power consumption. The LED converter can decide upon operational and/or maintenance parameters of the LED module to be set on the basis of stored tables of the identified power consumption, for example.

In accordance with one embodiment, the circuit is preferably designed to be activated each time when a supply voltage is applied to the LED module. In addition, the circuit is configured to be automatically deactivated when a preferably temporally limited starting phase has elapsed or come to an end. Thus, during continuous illuminated operation of the LED string, there are no power losses. In order to actuate the circuit, no additional connections are required. The circuit can be integrated in the LED module and does not need to be provided as a separate component. The circuit functions automatically after application of a supply voltage, i.e. a starting phase; it is therefore not necessary for any additional interaction to be performed.

In accordance with one embodiment, the circuit is preferably designed to be activated each time when a supply voltage between zero and the forward voltage of the LED string is applied to the LED module In addition, the circuit is configured to be automatically deactivated when the applied supply voltage reaches or exceeds the forward voltage of the connected LED string. Thus, during illuminated operation of the LED string, there are no power losses. In order to actuate the circuit, no additional connections are required. The circuit can be integrated in the LED module and does not need to be provided as a separate component. The circuit functions automatically in accordance with the applied supply voltage; it is therefore not necessary for any additional interaction to be performed.

As an alternative to the application of a supply voltage with a value of between zero and the forward voltage of the LED string, for activation of the circuit a preset supply current can also be fed into the LED string in order to activate the circuit on the LED string. For example, the LED converter can output the nominally minimum output current in accordance with its specification or a low minimum current value at which it is ensured that the LED module is not overloaded. In this case, the circuit is configured to be deactivated automatically, for example when the fed-in supply current reaches or exceeds the rated current of the connected LED string or when a preferably temporally limited starting phase has elapsed.

Preferably, the circuit is designed to represent a constant-current or constant-power load, which effects a constant current consumption or a constant power consumption of the LED module.

The circuit is therefore a constant load which can be activated selectively in the readout window of the supply voltage. Such a circuit makes possible a particularly simple embodiment of the present invention.

Alternatively, the circuit is configured to represent a variable-current load, which effects a change in the power consumption of the LED module in accordance with at least one preset protocol.

Owing to a variable power consumption, i.e. a load change of the LED module in the readout window, more complex information can be represented.

Preferably, the circuit is configured to code at least one operational and/or maintenance parameter of the LED module by the change in the power consumption in accordance with the at least one preset protocol.

In addition or as an alternative, the circuit on the LED module can also be designed in such a way that it is preferably activated only in a temporally limited starting phase of the LED module.

An LED converter can detect the change in the power consumption of the LED module and decode this change in accordance with the at least one protocol, which is stored in the LED converter, for example. Thus, a communications path from the LED module to the LED converter is enabled without additional lines or pins. Operational parameters of the LED module may be, for example, the forward current of an LED string of the LED module, the corresponding forward voltage of the LED string, a setpoint current of the LED module or a spectrum of the light emitted by the LED string. Maintenance parameters may be, for example, aging parameters of the LED module or the LED string, an operating duration of the LED module or a temperature at the LED module.

Preferably, the at least one preset protocol presets a frequency and/or an amplitude and/or a duty factor for the change in the power consumption of the LED module.

The at least one protocol can therefore be coded in many ways, namely as regards a frequency of the power consumption, an amplitude and switch-on clocking. As a result, complex information can be coded. Several different coded protocols can also be used.

Preferably, the circuit is configured in such a way that the change in the power consumption of the LED module is independent of a value of the first supply voltage.

The circuit on the LED module therefore reproduces the coding parameters (for example amplitude, frequency, duty factor of the load change) in the readout window (i.e. supply voltage unequal to zero but below the forward voltage of the LED string) independently of the supply voltage. As a result, a precise voltage preset does not need to be set in this readout window of the supply voltage, but rather just a constant voltage preset.

Alternatively, the circuit is configured in such a way that the change in the power consumption of the LED module is effected depending on a value of the first supply voltage in accordance with one of a plurality of preset protocols.

In accordance with this embodiment of the invention, when a supply voltage is applied, not always the same feedback information is transmitted to an LED converter which is connected to the LED module in the readout window, as described above. Instead, the voltage range of the supply voltage in which a connected LED string is still non-conducting can be divided into several subranges of the supply voltage. For each subrange, a different preset protocol can apply. This means that a different type of change in the power consumption can take place in each subrange (i.e. different in terms of frequency of the power consumption change, the amplitude of the power consumption change or the duty factor depending on the applied supply voltage). As a result, different information can be transmitted back to the LED converter. In this case, more complex protocols are also conceivable which include, for example, the modulation of the supply voltage, selective switching-on and switching-off of the supply voltage between zero and a voltage in the readout window, etc. In order to subdivide the range of information transmission further still, frequency modulations, amplitude modulations or PWM of the supply voltage are also conceivable.

Preferably, the circuit comprises a timer circuit, which is configured to preset a frequency of the change in the power consumption of the LED module. The timer circuit therefore presets the frequency of the load change of the LED module.

Preferably, the circuit is integrated in a semiconductor material of the LED module. As a result, the circuit can be formed in a particularly space-saving and inexpensive manner.

Advantageously, at least one sensor is provided on the LED module, which sensor is configured to influence an electrical parameter of the circuit. The LED converter can supply power to the sensor in an operating mode when the LED string is not active by virtue of the LED converter outputting a reduced supply voltage to the LED module. The at least one sensor may be, for example, a sensor or a combination of a plurality of sensors, which may be light sensors, temperature sensors, color sensors, presence sensors, etc. The influenced electrical parameter of the circuit on the LED module may be, for example, a resistance value or a conductivity.

Preferably, the at least one sensor is a light sensor having a light-dependent resistor, and the light sensor is connected to the circuit in such a way that a change in the light-dependent resistor changes the load resistance of the circuit.

A light sensor having a light-dependent resistor can be implemented easily. A luminous efficacy which falls on this resistor directly influences the resistance value thereof and therefore also the real power load of the circuit in the readout window.

The present invention furthermore relates to an LED converter for an LED module as described above, which is configured to detect a power consumption of the LED module for a first supply voltage present at the LED module at which an LED string connected to the LED module is non-conducting, and to determine, on the basis of the detected power consumption, at least one operational and/or maintenance parameter of the LED module.

Owing to the detected power consumption, the necessary information is transmitted to the LED converter in order to determine the operational and/or maintenance parameter. The LED converter can, for example, determine these parameters on the basis of one or more stored or saved tables, which correlate operational and/or maintenance parameters with constant or variable power consumptions within the readout window, for example.

Preferably, the LED converter is configured to: use the at least one determined operational and/or maintenance parameter to set or regulate the operation of the LED module, to store said operational and/or maintenance parameter in an assigned memory, to display said operational and/or maintenance parameter optically and/or acoustically, and/or to transmit said operational and/or maintenance parameter via a wireless or wired interface, possibly upon external request.

The LED converter is therefore suitable for comprehensively controlling the LED module. For this purpose, no separate communications path or additional lines or pins are required between the LED module and the LED converter. The transmission of information, for example the transmission of the operational and/or maintenance parameters, takes place via the connections for the supply voltage which are provided in any case.

Advantageously, the at least one operational and/or maintenance parameter is a setpoint current through an LED string connected to the LED module, an aging parameter, an operating duration and/or a spectrum of a light emitted by the LED string.

Advantageously, the LED converter is configured to identify the LED module on the basis of the at least one determined operational and/or maintenance parameter.

The identification can be performed using one or more stored tables, for example. If the LED converter has identified the LED module, further information can be stored in the one or more tables which enable comprehensive control of the LED module. In particular, a forward current of the LED string of the LED module is advantageous as stored information.

Advantageously, the LED converter is configured to signal to the LED module, by changing the supply voltage of the LED module, for example via pulse modulation or amplitude modulation of the supply voltage, to selectively change over to a mode for changing the power consumption of the LED module (load change). The modulation of the supply voltage can in this case assume various patterns or values, as a result of which targeted selection of individual LED modules can be made possible if an LED converter supplies power to a plurality of LED modules. The LED module selected in each case in this way can then selectively change over to the mode for load change in order to transmit information to the LED converter. The plurality of LED modules can be arranged in a series circuit or parallel circuit. The LED converter can be configured to call up various types of information from the LED module(s) by changing the supply voltage, for example via pulse or amplitude modulation of the supply voltage, depending on the respective pattern or value. Various tables for feeding back the different information can be stored in the LED module for this purpose.

For example, the LED converter is configured to change over selectively between a mode for detecting a power consumption of the LED module and a mode for illuminated operation of an LED string connected to the LED module by setting a first supply voltage or a second supply voltage for the LED module.

The first supply voltage is in this case a voltage in the readout window, i.e. a supply voltage between zero and a forward voltage, at which the connected LED string is still non-conducting. The second supply voltage is a voltage above the forward voltage at which the connected LED string is conducting, preferably illuminates. The LED converter is therefore set into the corresponding mode automatically on the basis of the set supply voltage. Detection of the power consumption only takes place in the mentioned detection mode. It is thus possible to disconnect detection circuits of the converter during illuminated operation and to save energy. Interaction with the LED converter from the outside is not necessary for the change of mode.

Preferably, the LED converter is configured to perform a current measurement for directly detecting the power consumption of the LED module.

Alternatively, the LED converter is configured to perform indirect detection of the power consumption of the LED module.

Preferably, the LED converter is configured to detect a change in the power consumption of the LED module as a result of a change in a duty factor of clocking of the LED converter, for example a buck converter (also referred to as step-down converter) or an isolated flyback converter.

Depending on the control concept for an LED module, the LED converter can also detect a change in the peak current in the LED converter, for example in an isolated converter, preferably an isolated flyback converter.

Advantageously, the LED converter is configured to discharge a capacitor via a load of the LED module, to determine a discharge current of the capacitor directly, or indirectly via a discharge time, and to determine the at least one operational and/or maintenance parameter of the LED module on the basis of this discharge current.

In particular, this embodiment of the LED converter is preferably used for an LED module with a constant-current load in the range of the readout window of the supply voltage. A capacitor in the LED converter is in this case discharged via a constant current sink on the LED module, for example, wherein the discharge current flowing in the process can be measured directly or indirectly via a discharge rate (negative gradient) of the voltage of the capacitor. The directly or indirectly detected discharge current can then be interpreted by the LED converter in respect of the operational and/or maintenance parameter. The information on the operational and/or maintenance parameter is therefore coded in the gradient of the voltage which is output by the LED converter when the capacitor is discharged. The measurement of the discharge rate eliminates the dependence on the absolute supply voltage. Detection of the discharge current via the discharge duration of the capacitor is likewise also conceivable. For this purpose, in addition the information on the absolute voltage can also be present or fed back to the LED converter at the beginning and end of the measurement, i.e. the discharge of the capacitor.

In addition, the present invention relates to an LED luminaire comprising an LED module, as described above, and an LED converter, likewise as described above.

The present invention furthermore relates to a method for transmitting information from an LED module to an LED converter, the method comprises: activating a circuit in order to represent a load, preferably a real power load, when a first supply voltage unequal to zero is present at the LED module at which a connected LED string is non-conducting, and deactivating the circuit in order to represent no load when a second supply voltage unequal to zero is present at the LED module at which a connected LED string is conducting.

The present invention also relates to a method for determining information with respect to an LED module on an LED converter, the method comprises: detecting a power consumption of the LED module for a first supply voltage present at the LED module at which an LED string connected to the LED module is non-conducting, and determining at least one operational and/or maintenance parameter of the LED module on the basis of the detected power consumption.

The present invention furthermore relates to a method for transmitting information from an LED module to an LED converter comprising a converter with high-frequency clocking having a transformer, the method comprises activation of a circuit at least during a temporally limited starting phase in order to represent a load, preferably a real power load, and detecting a power consumption of the LED module on the primary side of the transformer of the converter with high-frequency clocking.

The present invention also relates to a method for determining information with respect to an LED module using an LED converter comprising a converter with high-frequency clocking having a transformer, the method comprises detecting a power consumption of the LED module on the primary side of the transformer of the converter with high-frequency clocking, wherein a circuit on the LED module effects a modulated load change at least during a starting phase, and determining at least one operational and/or maintenance parameter of the LED module on the basis of the detected power consumption.

Overall, the present invention makes it possible to transmit information regarding operational and/or maintenance parameters to be set on an LED module to an LED converter. In this case, no further connections or link between the LED converter and the LED module are required. No further components apart from a load modulation circuit, which is advantageously integrated in a semiconductor material of the LED module, are required. No additional interaction with the LED module or the LED converter for the transmission of the information needs to be performed. The present invention therefore enables simpler control of an LED module and production of the LED module and/or LED converter at less cost and with a more compact design.

The present invention also relates to a method for determining information with respect to an LED module using an LED converter, said method comprising detecting a power consumption of the LED module, wherein a circuit on the LED module effects a modulated load change at least during a starting phase, and determining at least one operational and/or maintenance parameter of the LED module on the basis of the detected power consumption.

BRIEF DESCRIPTION OF THE DRAWINGS

The present invention will now be described in more detail with reference to the attached figures.

DETAILED DESCRIPTION OF THE PREFERRED EMBODIMENTS

Figure 1:
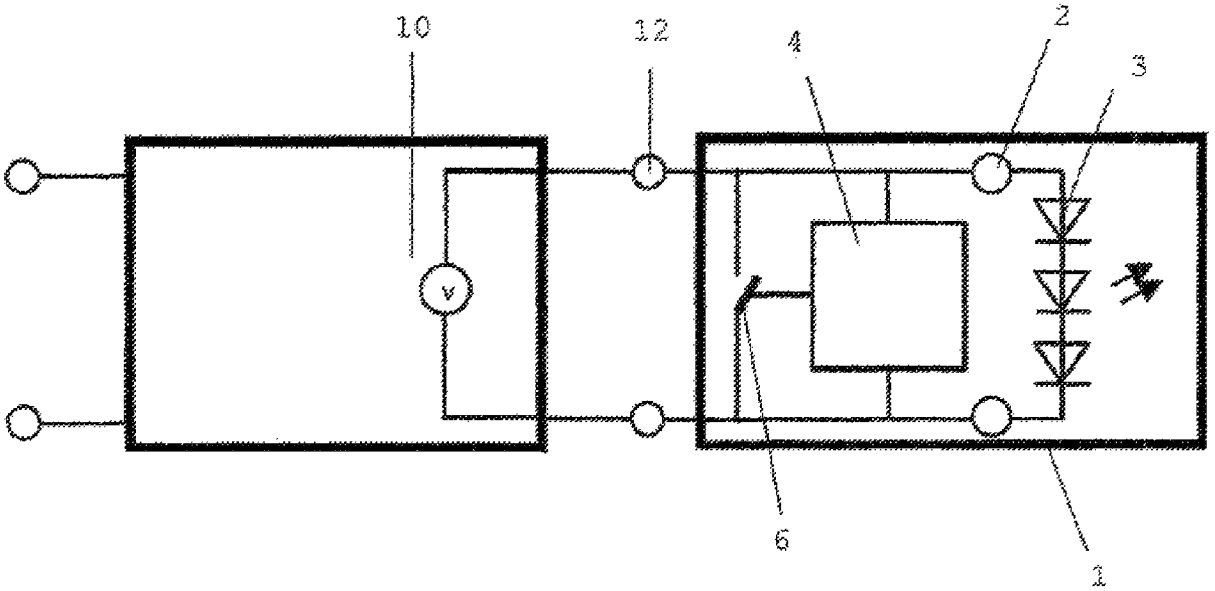
FIG. 1 shows, schematically, the basic principle of the present invention on the basis of an LED luminaire according to the invention (consisting of an LED module according to the invention and an LED converter according to the invention).

FIG. 1 shows, schematically, an LED luminaire according to the invention, which consists of an LED module 1 according to the invention and an LED converter 10 according to the invention. The LED converter 10 is connected to the LED module 1 via one or more voltage connections 12. The LED converter 10 therefore supplies a supply voltage to the LED module 1. The LED converter 10 can also be configured for operating a plurality of LED modules 1. Preferably, the supply voltage is a DC voltage, but can also be a clocked voltage or AC voltage. The LED converter 10 preferably has a converter with high-frequency clocking, for example a buck converter (step-down converter), isolated flyback converter or a resonant half bridge converter (preferably isolated, for example an LLC converter). The LED converter 10 can output, for example, a constant output voltage or a constant output current at its voltage connections 12, wherein the voltage at these connections corresponds to the supply voltage of the LED module 1.

The supply voltage is applied to at least one LED string 3 connected to the LED module 1 (said LED string also includes a single LED) via one or more connections 2 of said LED module. The LED string 3 does not need to be part of the LED module 1 according to the invention, but can be a connectable and replaceable LED string 3. The LED module 1 according to the invention therefore only requires connections 2 for at least one LED string 3. However, the LED string 3 can also be fixedly installed with the LED module 1. The LED string 3 can have one or more LEDs, which are connected in series as shown in FIG. 1, for example. LEDs in an LED string 3 can all illuminate with the same color, i.e. emit light of the same wavelength, or can illuminate in different colors. For example, a plurality of LEDs, preferably red-emitting, green-emitting and blue-emitting LEDs, can be combined in order to generate a mixed radiation, preferably white light.

The LED string 3, if it is connected to the connections 2, is connected in parallel, with respect to the supply voltage, with a circuit 4. The circuit 4 is designed, for example, in such a way that it represents a load, preferably a real power load, for the LED converter 10 if the supply voltage applied to the connections 12 by the LED converter 10 is not equal to zero but is still so low that the LED string 3 connected to the connections 2 is still non-conducting. The circuit 4 can therefore also be referred to as load circuit or load modulation circuit.

Figure 2:
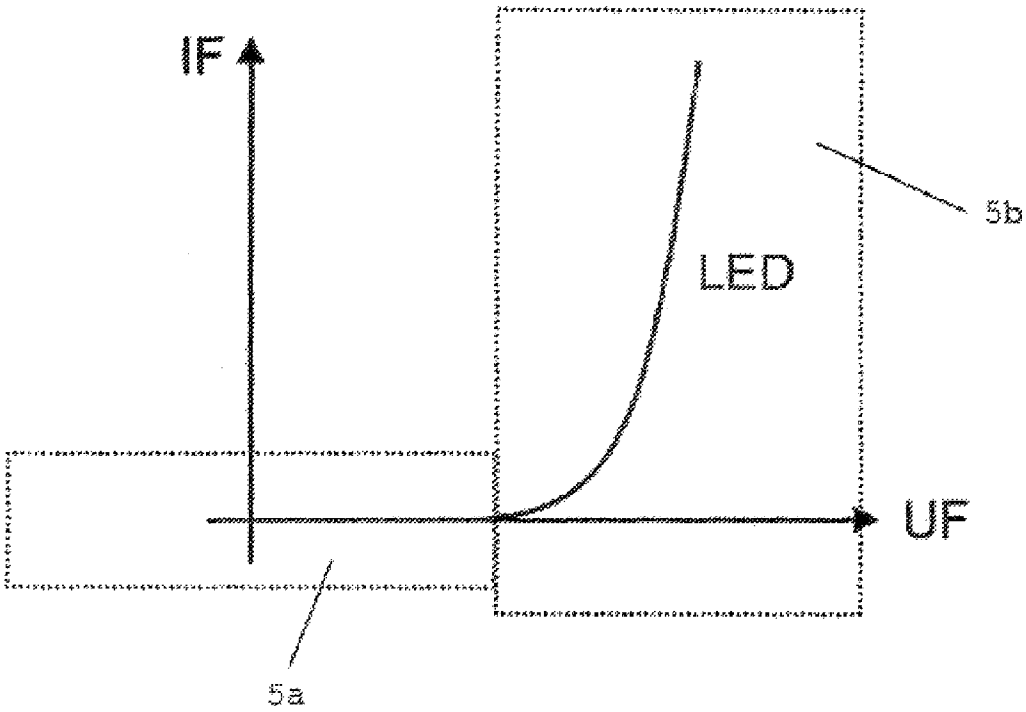
FIG. 2 shows a current/voltage characteristic of an LED string and the readout window according to the invention.

FIG. 2 shows, by way of example, a current/voltage characteristic of an LED string 3, in which a current through the LED string is plotted in the vertical direction and the voltage across the LED string (i.e. the supply voltage in FIG. 1) is plotted in the horizontal direction. For a first voltage range, (i.e. a first supply voltage 5*a* within the readout window), the voltage across the LED string 3 is not equal to zero, but the current through the LED string 3 is also still virtually zero since the LED string 3 is non-conducting. The supply voltage is therefore below the forward voltage. The LED string 3 represents an infinite load for the LED converter 10. The LED module 1 therefore does not consume any power via the LED string 3. In a second voltage range (i.e. for a second supply voltage 5*b* outside the readout window), the LED string 3 is conducting and a current flows through the LED string 3, which causes said LED string to illuminate. The supply voltage is therefore above the forward voltage.

The circuit 4 on the LED module 1 is designed, for example, in such a way that it is activated when the first supply voltage 5*a* is present and thus represents a load, preferably a real power load, for the LED converter 10. For the second supply voltage 5*b*, i.e. during illuminated operation of the LED string 3, the circuit 4 is deactivated and represents no load for the LED converter. This is illustrated schematically in FIG. 1 by the switch 6, which automatically activates or deactivates the circuit 4 depending on the present supply voltage. The circuit 4 can either represent a constant-current load or a variable-current load for the LED converter 10. The circuit 4 effects a power consumption of the LED module 1 although an LED string 3 is still non-conducting and does not consume any power. A conventional LED module 1 would not consume any power in the readout window. In addition or as an alternative, the circuit 4 on the LED module 1 can also be designed in such a way that it is only activated in a temporally limited starting phase of the LED module 1.

The power consumption of the LED module 1 in the readout window can be a constant-current or variable-current power consumption, depending on the type of circuit 4. The LED converter 10 can detect the power consumption of the LED module 1 or a change in the power consumption of the LED module 1 and decide upon operational and/or maintenance parameters of the LED module 1 to be set on the basis of the detected power consumption. The LED converter 10 can use the operational and/or maintenance parameters directly for setting or regulating the LED module 1. The LED converter 10 can also store the operational and/or maintenance parameters in a memory assigned to said LED converter, however, and possibly use said operational and/or maintenance parameters later, or can display the parameters optically and/or acoustically to a user, or can transmit said operational and/or maintenance parameters to a further device, for example a control unit of a lighting system. The transmission can take place either wirelessly or in wired fashion and can be performed either automatically or only upon request from the further device.

In order to operate an LED module 1 by means of the LED converter 1 of the present invention, various operations can be implemented in a preferably temporally limited starting phase of the LED luminaire. First, the LED converter 10 supplies, for example, a constant supply voltage, preferably a constant DC voltage, to the LED module 1. For example, the LED converter 10 can be operated with a switch-on ratio which is reduced in comparison with normal operation, as a result of which a lower output voltage is achieved. The supply voltage is in this case a first supply voltage 5*a*, i.e. it is within the readout window shown in FIG. 2. Since the first supply voltage 5*a* is not equal to zero, the circuit 4 on the LED module 1 is activated and represents a load for the LED converter 10. The load is preferably a real power load and produces a power consumption of the LED module 1. The LED converter 10 can now measure, for example, a discharge current of a capacitor via this load, an absolute current consumption of the circuit 4, a frequency of a change in the power consumption of the LED module 1, or a duty factor or an amplitude of a change in power consumption. On the basis of the result of the measurement, the LED converter 10 can decide upon operational and/or maintenance parameters. For example, the LED converter 10 can determine a setpoint or forward voltage or a setpoint current of the LED module and apply this to the LED module 1. Thus, a connected LED string 3 is turned on and the LED converter 10 operates the LED module 1 in the illuminated operating mode. Preferably, the circuit 4 is now deactivated automatically. As a result, the circuit 4 does not consume any power during illuminated operation of the LED string 3 and therefore does not influence the illuminated operation of the LED string 3. The LED converter 10 of the LED luminaire therefore has automatically identified the LED module 1 and set the appropriate operational parameters.

As an alternative or in addition, the LED module 1 can also be read by the LED converter 10 in temporally limited fashion by virtue of the circuit 4 only being active during a starting phase on the basis of a preset time span as soon as a supply voltage is applied to the LED module 1. This supply voltage can in this case also correspond to the nominal output voltage of the LED converter 10 for normal operation. Once the supply voltage has been applied, the circuit 4 on the LED module 1 is activated and represents a load for the LED converter 10. The load is preferably a repeatedly changing real power load and produces a power consumption of the LED module 1. In addition, in this case the connected LED string 3 can also be turned on, whereby the LED converter 10 operates the LED module 1 during illuminated operation. The LED converter 10 can now measure, for example, a discharge current of a capacitor via this load, an absolute current consumption of the circuit 4, a frequency of a change in the power consumption of the LED module 1 or a duty factor or an amplitude of a change in power consumption. On the basis of the result of the measurement, the LED converter 10 can decide upon operational and/or maintenance parameters. For example, the LED converter 10 can determine a setpoint or forward voltage or a setpoint current of the LED module and apply this to the LED module 1. Preferably, the circuit 4 is now deactivated automatically once the preset time span for the starting phase has elapsed. The presetting of this time span for the starting phase can, for example, be fixed by a time-charging circuit, wherein a timer capacitor is charged and the circuit 4 is deactivated once the timer capacitor has been charged. The circuit 4 thus does not consume any power during continuous illuminated operation of the LED string 3 and therefore does not influence the illuminated operation of the LED string 3.

Figure 3:
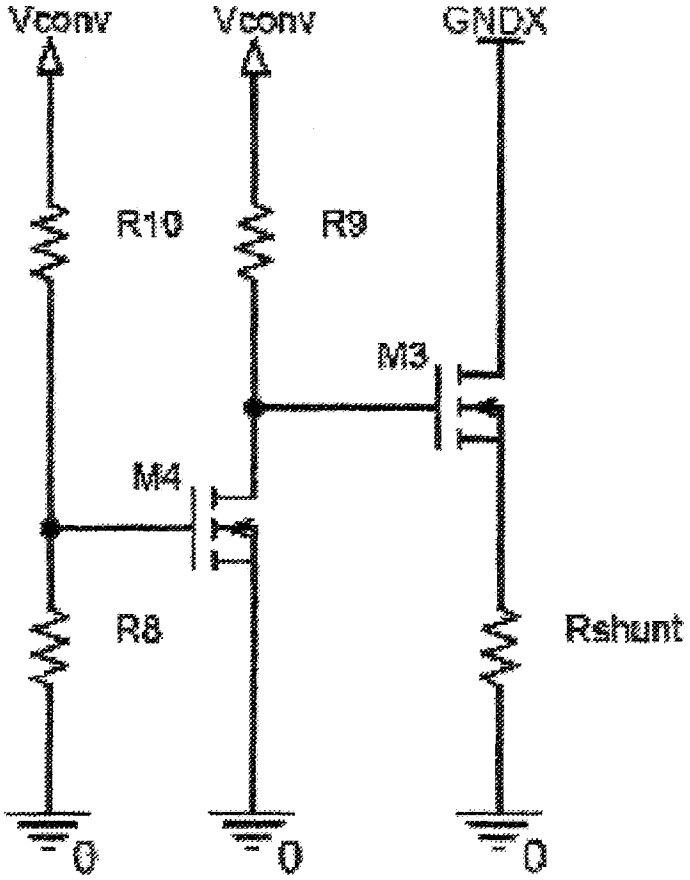
FIG. 3 shows a circuit, which enables automatic deactivation of the circuit on the LED module according to the invention.

FIG. 3 shows a circuit which is at least part of the circuit 4 for deactivating said circuit 4 automatically if the supply voltage is in the region of the second supply voltage 5*b*, i.e. is above the forward voltage of the LED string 3. The circuit 4 can be deactivated by means of the transistors M4 and M3. As the supply voltage which is provided by the LED converter 10 and is present at the circuit 4 on the LED module 1 increases, the voltage across the resistor R8 also increases. If this voltage reaches a threshold voltage of the transistor M4, said transistor closes and also deactivates the transistor M3 by virtue of it connecting the gate voltage of the transistor M3 to ground. The threshold voltage can be 1.4 volts, for example (in the case of a voltage of 12.5 volts of the LED converter 10). In order to reduce losses of the voltage divider R8 and R10, the resistance values should be high, preferably in the range of from 20 to 200 kΩ, more preferably still in the range of from 40 to 100 kΩ. In addition, it is important that the transistor M3 is configured to withstand the maximum supply voltage which the LED converter 10 can apply and that the voltage across the resistor R8 does not exceed the maximum permissible gate voltage of the transistor M4 during normal illuminated operation of the LED string 3. As an alternative or optionally, this circuit can be configured, for example by means of an RC element, such that it is deactivated once a preset starting time has elapsed (wherein this time corresponds to the starting phase) by virtue of the transistor M3 being deactivated, i.e. opened, depending thereon. For example, a capacitor can be arranged in parallel with the resistor R8. This capacitor can be configured in such a way that it is charged by the applied supply voltage once the preset starting time has elapsed and therefore the voltage across the parallel resistor R8 has also increased to such an extent that this voltage has reached a threshold voltage of the transistor M4, with the result that said transistor closes and deactivates the transistor M3 by virtue of it connecting the gate voltage of the transistor M3 to ground.

Figure 4:
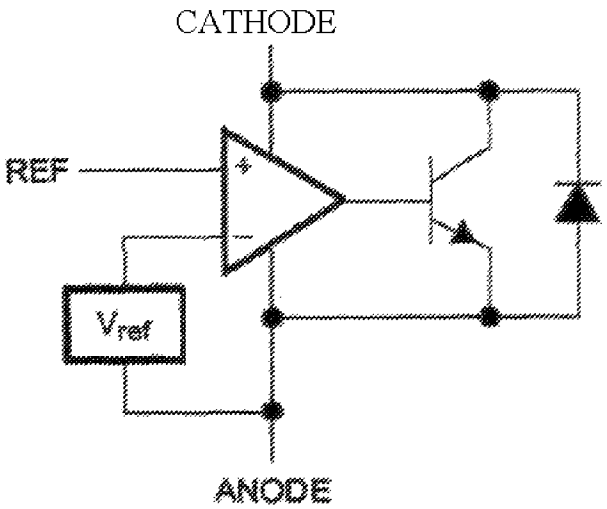
FIG. 4 shows an example of the circuit on the LED module according to the invention which represents a constant-current load.
Figure 4:
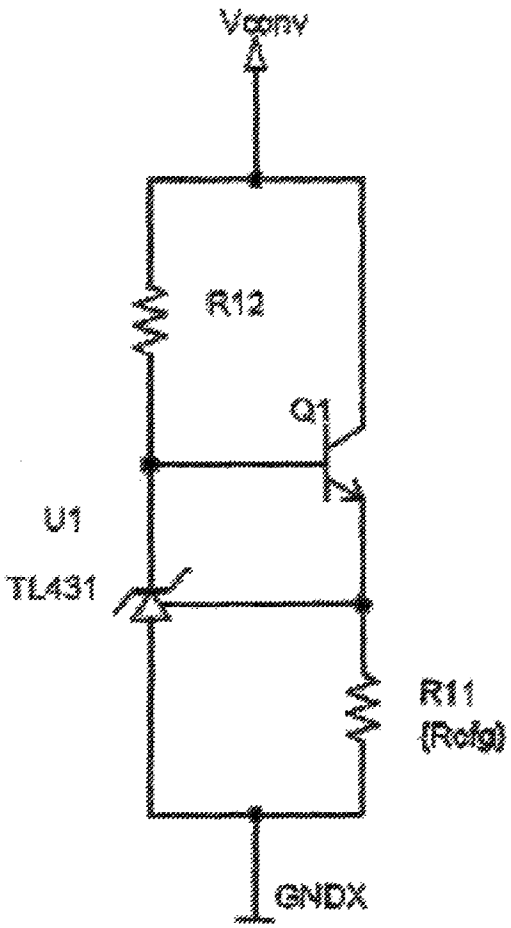

FIG. 4 shows, by way of example, a circuit TL432, which is at least part of the circuit 4, which is configured to represent a constant-current load for the LED converter 10 in the readout window. The left-hand side of FIG. 4 shows a circuit diagram of the circuit, and the right-hand side shows a corresponding equivalent circuit diagram for the circuit TL431 or TL432. The constant current is determined by a ratio of the reference voltage of the circuit TL431 to the resistance value of the selecting resistor R11 (Rcfg). A transistor Q1 is preferably controlled to such an extent that the voltage across the resistor R11 (Rcfg) is always approximately 2.5 volts. A minimum current of approximately 1 mA should flow through the circuit TL431. The circuit shown in FIG. 3 can be arranged in series with the circuit shown in FIG. 4 so that the series circuit of the two is arranged in parallel with the LED string on the LED module 1. Preferably, the virtual ground GNDX of the circuit in FIG. 4 is connected to the drain connection of the transistor M3.

The LED converter 10, in order to measure the constant current, can discharge a capacitor 11, for example, via a constant-current load as shown in FIG. 4, for example. The constant current through the circuit 4 (which corresponds to the discharge current of the capacitor 11) can be determined directly or indirectly on the basis of either the discharge duration and/or the discharge rate. On the basis of the discharge current, the LED converter can decide upon the circuit 4 used and therefore upon the connected LED module 1. In addition, the LED converter 10 can determine operational and/or maintenance parameters of the LED module, for example on the basis of stored tables.

Figure 5:
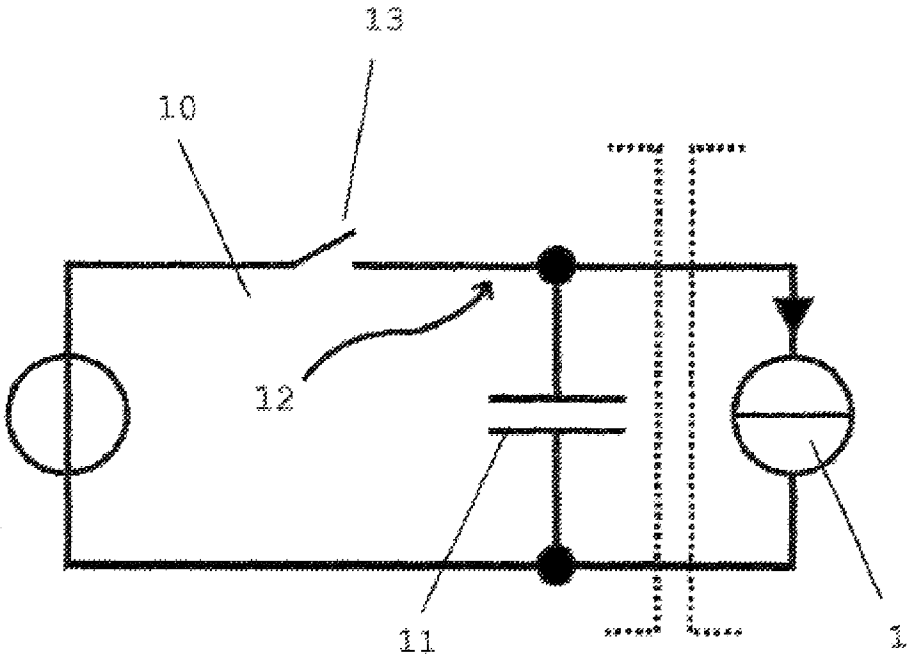
FIG. 5 shows, schematically, the detection of a constant-current load on the LED module according to the invention by the LED converter according to the invention.

The concept of the determination of the constant current through the circuit 4 is illustrated schematically in FIG. 5. For example, the LED converter 10 can be in the form of a buck converter, by way of example. The LED converter 10 is provided with the capacitor 11, which can be connected in parallel with the connections 12 for the supply voltage. The voltage at the connections 12 is monitored by the LED converter 10. If the supply voltage is disconnected from the LED module 1 by opening of the switch 13, which is arranged in the LED converter 10 and preferably has high-frequency clocking during operation of the LED converter, the capacitor 11 is discharged via the preferably constant current load, which is represented by the circuit 4 on the LED module 1. The discharge rate, i.e. the change in the voltage of the capacitor which is present at the connections 12, is preferably measured by the LED converter 10 in order to decide upon the operational and/or maintenance parameters of the LED module 1, as described. For example the resistor R11, the constant current load shown in FIG. 4, can be determined when the capacitance of the capacitor 11 is known. This resistance value can then code the operational and/or maintenance parameter, i.e. the LED converter 10 can correlate this resistance value with operational and/or maintenance parameters in stored tables, for example.

Figure 6:
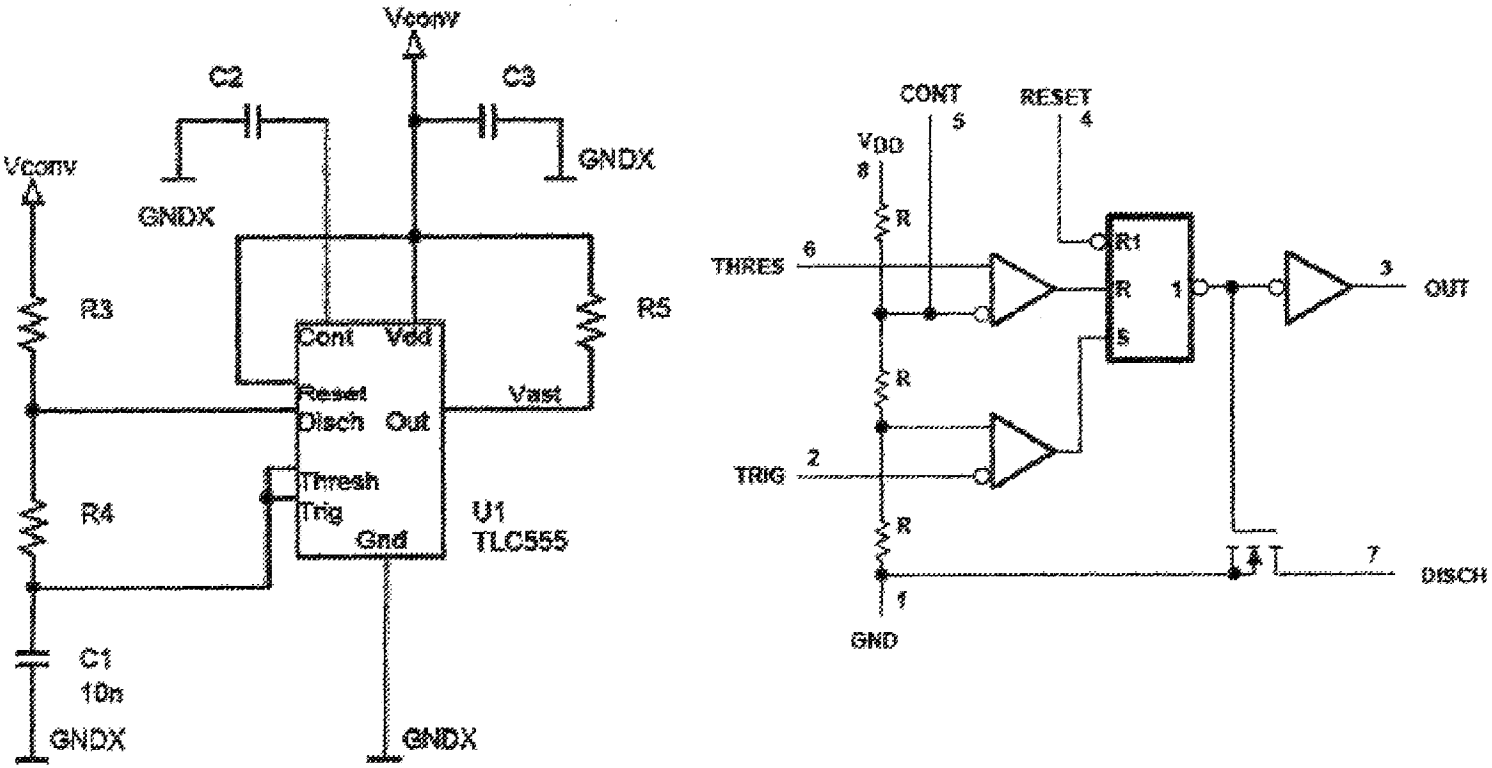
FIG. 6 shows a circuit on the LED module according to the invention which represents a variable-current load and in particular sets a frequency of the change in the power consumption of the LED module according to the invention.

FIG. 6 shows a circuit TLC555, which is at least part of the circuit 4 and is suitable for producing a change in load of the LED module 1 at a determined frequency, i.e. a change in the power consumption of the LED module 1. A circuit diagram is shown on the left-hand side in FIG. 6, and a corresponding equivalent circuit diagram for the circuit TLC555 is shown on the right-hand side. For example, a capacitor C1 can be charged and discharged between ⅓ and ⅔ of the supply voltage 5*a* applied by the LED converter 10. As long as the supply voltage 5*a* applied by the LED converter 10 is constant, a frequency of the load change, a duty factor of the load change or an amplitude of the load change (i.e. a difference between a load prior to the change and a load after the change) can thus be set. This also brings about a change in the power consumption at a corresponding frequency, duty factor or an amplitude.

The frequency f of the change is in this case defined as $$f=1/\{(R3+2\cdot R4)\cdot C1\cdot In(2)\},$$

where R3, R4 and C1 are resistance or capacitance values of the components shown in FIG. 6.

The duty factor is defined by the ON time ($T_{high}$) and the OFF time ($T_{low}$), where $$T_{high}=(R3+R4)\cdot C1\cdot In(2)$$

and $$T_{low}=R4\cdot C1\cdot In(2).$$

A change in the duty factor is possible both owing to a change in the pulse duration (switch-on duration, ON time, $T_{high}$) and by a change in the interpulse duration (switch-off duration, OFF time, $T_{low}$).

The magnitude of the load is determined by the resistance of the resistor R5 and the convertor voltage $V_{CONV}$ (more precisely the ratio of $V_{CONV}$/R5).

The circuit 4 can be configured, for example, in such a way that it is only activated during the starting phase of the LED luminaire. This can be achieved, for example, by virtue of the fact that the supply to the circuit TLC555 with the aid of a timer such as an RC element, for example, this timer can be configured, for example, in such a way that the supply for the circuit TLC555 is only present for a time of 100 milliseconds, for example, and then, owing to charging of the capacitor of the RC element via a series resistor (starting from the supply voltage of the LED module 1), a preset voltage level is reached, which results in disconnection of the supply voltage Vcc for the circuit TLC555 (example not illustrated). For example, the base of a turn-off transistor (not illustrated) can be actuated via the voltage drop across the RC element, said turn-off transistor drawing the supply Vcc for the circuit TLC555 to ground as soon as the RC element has been charged. The charging time of the RC element can in this case be configured such that a time of 100 milliseconds, for example, is reached, wherein this time corresponds to the starting phase. Run-up of the circuit TLC555 at the beginning of the starting phase can take place by a high-resistance feed directly from the supply voltage of the LED module 1, wherein this supply voltage is drawn to ground at the end of the starting phase by means of the voltage drop across the RC element via the turn-off transistor in the manner of a pull-down configuration. The circuit 4 can have a controllable switch, which connects or disconnects the resistor R5 depending on the output signal OUT of the circuit TLC555 and therefore effects the load change.

The circuit shown in FIG. 3 can be arranged in series with the circuit shown in FIG. 6 with the result that the series circuit comprising the two is arranged in parallel with the LED string on the LED module 1. Preferably, the virtual ground GNDX of the circuit in FIG. 6 is connected to the drain connection of the transistor M3. Deactivation of the circuit in FIG. 6 can take place in time-controlled fashion, for example. As has already been explained in the example in FIG. 3, a capacitor can be arranged in parallel with the resistor R8. In this case, an RC element is likewise formed. The charging time of the RC element can in this case be configured in such a way that a time of 100 milliseconds, for example, is reached, wherein this time corresponds to the starting phase. Once the starting time preset by the dimensioning of the RC element has elapsed, the voltage at the gate of the transistor 4 has reached a threshold voltage of the transistor M4, with the result that said transistor closes and deactivates the transistor M3 by virtue of it connecting the gate voltage of the transistor M3 to ground. In this way, the circuit shown in FIG. 6 can only be activated for a preset starting phase.

If, owing to the circuit 4, a repeatedly changing load change (i.e. a modulated load change) is produced and output, it is also possible for two different items of information to be transmitted, for example. For example, both the frequency and the duty factor of the load change can be changed. In this case, a first item of information (for example the setpoint voltage) could be transmitted in coded form by means of the frequency, while a second item of information (for example the setpoint current) can be transmitted in coded form via the duty factor. A further possibility for the combined transmission of at least two items of information would be the corresponding change in the pulse duration (switch-on duration, ON time, $T_{high}$) and the interpulse period (switch-off duration, OFF time, $T_{low}$) of the load change.

Figure 7:
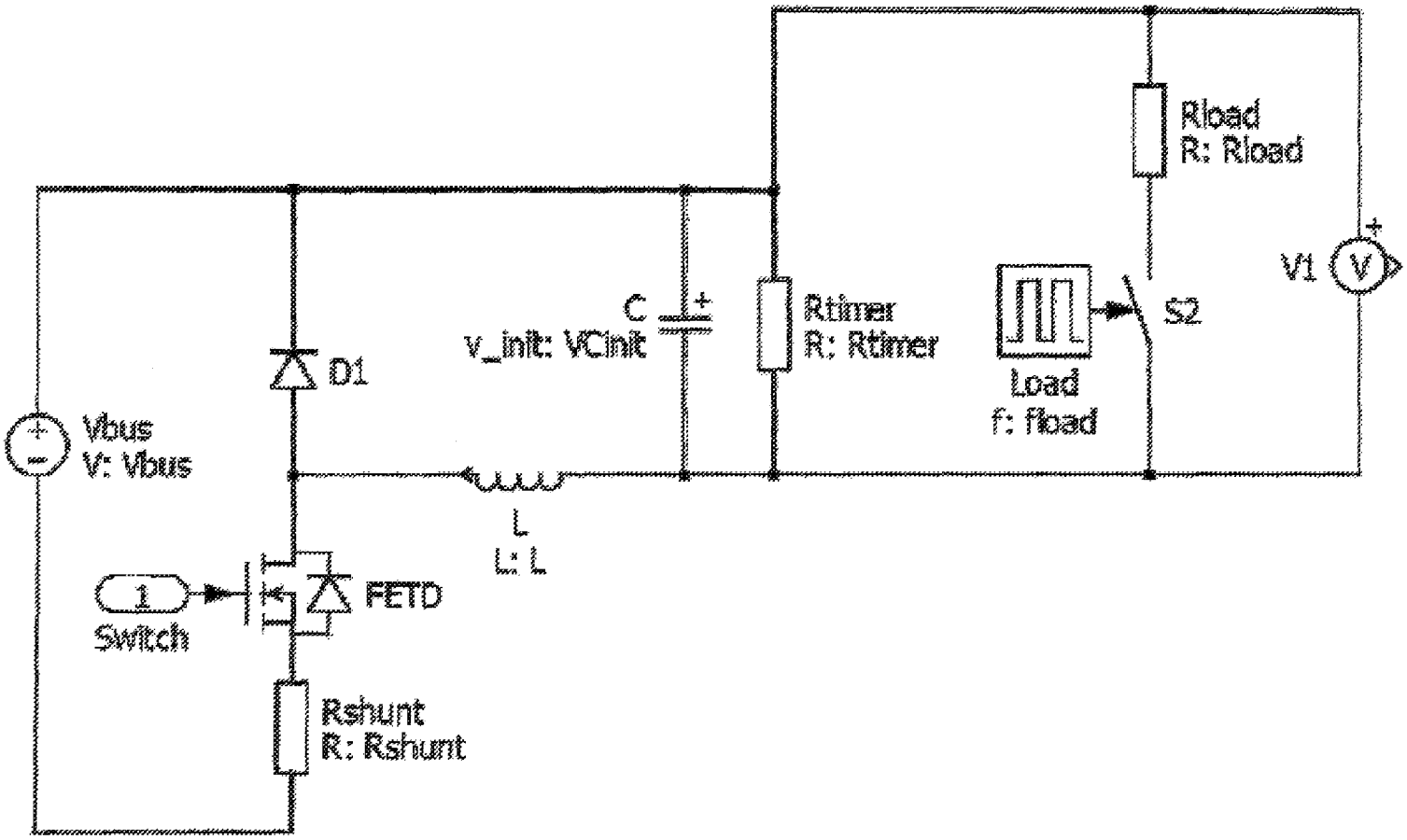
FIG. 7 shows how a change in the power consumption of the LED module according to the invention can be measured using a buck converter as an example of an LED converter according to the invention.
Figure 8:
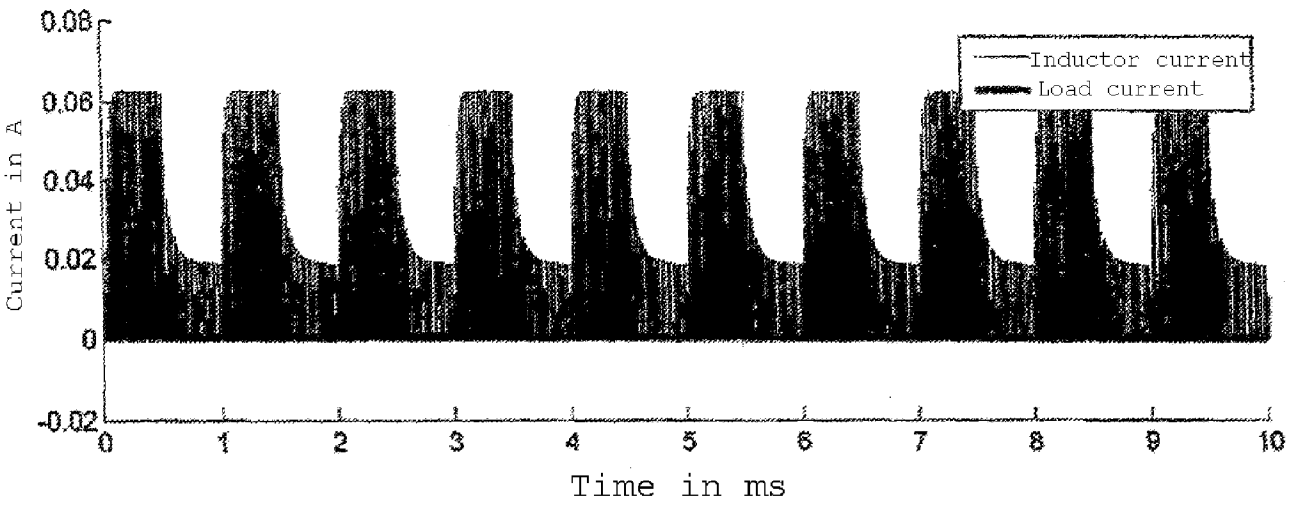
FIG. 8 shows how a change in the current through the circuit on the LED module according to the invention correlates with the current in a buck converter of the LED converter according to the invention.
Figure 8:
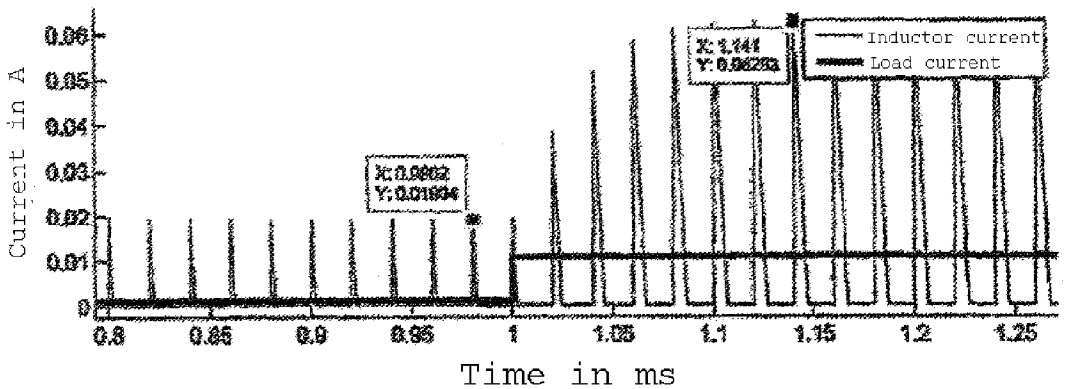

The change in the power consumption of the LED module 1 can be determined by the LED converter 10, for example by direct current measurement of the current through the circuit 4. Alternatively, the LED converter 10 can perform measurements at a buck converter as shown in FIG. 7, wherein the buck converter is preferably part of the LED converter 10. Thus, FIG. 8 shows, for example, how the current through the circuit 4 and the current at the buck converter, which is measured via a shunt, correlate with one another. FIG. 8 shows, at the top, the current "load current" through the circuit 4 and the current "inductor current" through the buck converter plotted over time. The buck converter in this case only represents an example of a converter with high-frequency clocking; alternatively, an isolated flyback converter, a boost converter (step up converter) or a resonant half bridge converter (preferably isolated, for example an LLC converter) can also be used for feeding the LED module 1, for example.

The LED converter can have a buck converter, as shown in FIG. 7. The buck converter can be operated as a constant current source, i.e. regulated to a constant output current. In this case, the output voltage of the buck converter, i.e. the voltage which is output at the output of the LED converter 10 and corresponds to the voltage across the LED module 1, can be detected and evaluated, for example. In addition or as an alternative, the duration of the switch on time and the switch off time of the actuation of the switch with high-frequency clocking of the buck converter can also be monitored and evaluated in order to identify a load change and therefore read information from the LED module 1.

The buck converter can also be operated as a constant voltage source, i.e. regulated to a constant output voltage. In this case, a load change at the LED module 1 will result in a change in the peak current set by the switch with high-frequency clocking during the switch on phase of the switch with high-frequency clocking of the buck converter, wherein this change can be detected. In addition or as an alternative, the duration of the switch on time and the duty factor of the actuation of the switch with high-frequency clocking of the buck converter can also be monitored and evaluated in order to identify a load change and therefore to read information from the LED module 1. Alternatively, during operation as a constant voltage source, the level of the output current can also be evaluated in order to identify a load change.

The buck converter can be operated at a fixed duty factor with a fixed frequency, preferably in a continuous conduction mode. In the case of such an operation, the level of the output current and/or the output voltage can be evaluated in order to identify a load change.

The buck converter of the LED converter 10 can supply a constant supply voltage, preferably a constant DC voltage, to the LED module 1, for example in a starting phase. In this case, the buck converter is operated as constant voltage source in the starting phase. For example, the LED converter 10 can be operated with a switch-on ratio which is reduced in comparison with normal operation, as a result of which a lower output voltage is achieved. The supply voltage can in this case be a first supply voltage 5*a*, i.e. it can be within the readout window, which is shown in FIG. 2. The buck converter can also supply a regulated current to the LED module 1 in a starting phase, in which case the buck converter is preferably operated as a constant current source.

FIG. 8 shows, at the bottom, an enlarged view of this plotting. The greater the load of the circuit 4, the greater a duty factor or a peak current at the shunt. Depending on a control principle of the LED module 1 by the LED converter 10, a peak current at the shunt of the buck converter or else a change in the duty factor at the buck converter can also be measured. The change in the load of the circuit 4 or the power consumption of the LED module 1 can be detected directly at the shunt at the low-potential switch of the buck converter, either by a periodic change in the duty factor or a periodic change in the peak current, which correlates with a periodic change in the power consumption of the LED module 1.

As already mentioned, the LED converter 10 can have, for example, an isolated converter comprising a transformer for high-frequency energy transmission (isolated, preferably an isolated flyback converter) for supplying power to the LED module 1. If the LED converter 10 is isolated (for example is in the form of an isolated flyback converter), i.e. has a transformer, the detection of the load change by the LED converter 10 can also take place on the primary side of the LED converter 10.

For example, when using an isolated flyback converter, the current on the primary side of the LED converter 10, which flows through the primary side of the transformer, can be detected. In this case, for example, the current though the clocking switch, which is arranged in series with the primary winding of the transformer, or else the current through the primary winding of the transformer can be detected, preferably by means of a shunt (current measuring resistor) connected in series therewith. For example, on the basis of the peak current at the shunt, the present load or else the load change of the LED module 1 and therefore a change in the duty factor on the primary side of the LED converter 10, for example, can be measured. For example, the change in the primary side current over time can also be detected. For example, detection of the power transmitted from the primary side can take place using the measurement of the primary side current and measurement or at least knowledge of the voltage fed to the converter. It would be possible, for example, for an active power factor correction circuit such as a step up converter circuit, for example, to be connected upstream of the converter, said active power factor correction circuit providing the input voltage for the isolated converter with high-frequency clocking such as, for example, the isolated flyback converter, and regulating this input voltage to a preset value. This preset value for the input voltage regulated by the active power factor correction circuit for the converter with high-frequency clocking is known owing to the preset (for example via a voltage divider) and can thus be taken into consideration in the detection of the power transmitted from the primary side.

The LED converter can have an isolated flyback converter, as already mentioned. The isolated flyback converter can be operated as a constant current source, i.e. can regulate to a constant output current. In this case, for example, the output voltage of the isolated flyback converter, e.g. the voltage which is output at the output of the LED converter 10 and which corresponds to the voltage across the LED module 1, can be detected and evaluated. The output voltage can be detected directly or else indirectly, for example by means of a measurement of the voltage across a primary side winding of the transformer of the isolated flyback converter. In addition or as an alternative, the duration of the switch off time of the actuation of the switch with high-frequency clocking of the isolated flyback converter can also be monitored and evaluated in order to identify a load change and therefore to read out information from the LED module 1.

The isolated flyback converter can also be operated as a constant voltage source, i.e. can be regulated to a constant output voltage. In this case, a load change at the LED module 1 will result in a change in the output current, wherein this change can be detected. This change in the output current can result in a change in the peak current set by the switch with high-frequency clocking during the switch on phase of the switch with high-frequency clocking of the isolated flyback converter, for example. The monitoring of the primary side current by the switch with high-frequency clocking can thus be used for monitoring a load change in order to thus read information from the LED module 1.

The isolated flyback converter can also be operated at a fixed duty factor at a fixed frequency. In the case of such operation, the level of the output current and/or the output voltage can be evaluated in order to identify a load change. If only the LED string of the LED module is active, the output voltage will then assume the value of the forward voltage of the LED string. If a load change by the circuit 4 takes place, the output voltage will drop. This change can be detected as a load change.

The LED converter can have an isolated resonant half-bridge converter, such as a so-called LLC converter, for example, as already mentioned. The LLC converter can be operated as a constant current source, i.e. can be regulated to a constant output current. In this case, for example, the output voltage of the isolated flyback converter, i.e. the voltage which is output at the output of the LED converter 10 and which corresponds to the voltage across the LED module 1, can be detected and evaluated. This output voltage can be detected directly or else indirectly, for example by means of a measurement of the voltage across a primary-side winding of the transformer of the LLC converter. If only the LED string of the LED module is active, the output voltage will then assume the value of the forward voltage of the LED string. If a load change by the circuit 4 takes place, the output voltage will then drop. This change can be detected as a load change. In addition or as an alternative, the clock frequency of the LLC converter which is set owing to the control loop can also be monitored and evaluated in order to identify a load change and therefore read information from the LED module 1. If the control loop of the LLC converter is configured in such a way that a frequency stop of the actuation of the half-bridge of the LLC converter is reached during the load change by the circuit 4, this can also be evaluated in order to read information.

The isolated resonant half-bridge converter, such as the LLC converter, for example, can also be operated as a constant voltage source by virtue of it being operated at a fixed frequency, wherein the frequency is selected such that the resultant voltage at the output is below the value of the forward voltage of the LED string. In this case, a load change at the LED module 1 will result in a change in the output current, wherein this change can be detected. This change in the output current can take place, for example, on the secondary side of the LLC converter and can be transmitted to the primary side by means of a coupling element, such as a current transformer, for example. The monitoring of the output current can thus be used for monitoring a load change in order thus to read information from the LED module 1.

Figure 13:
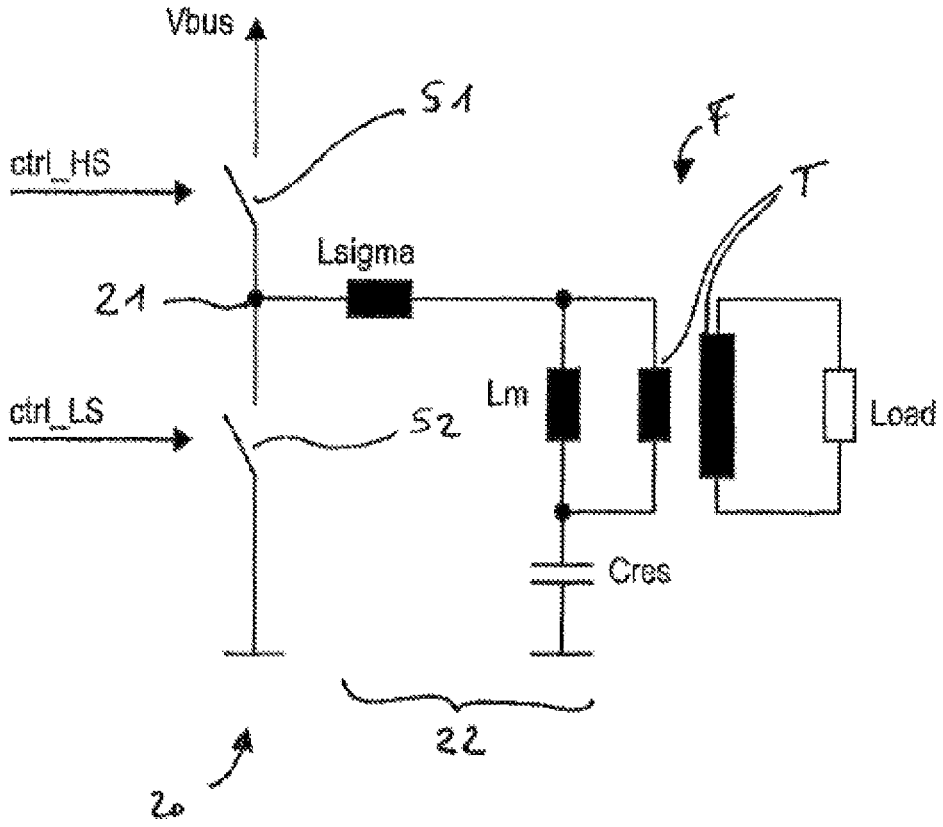
FIG. 13 shows, as an exemplary embodiment of the LED converter, an isolated resonant half bridge converter, which is illustrated by way of example here as an LLC converter.

FIG. 13 shows, as an exemplary embodiment of the LED converter 10, an isolated resonant half-bridge converter B, which is illustrated by way of example here as an LLC converter.

FIG. 13 shows that the bus voltage Vbus is supplied to an inverter 20, which can be in the form of a half-bridge inverter comprising two switches S1, S2, for example. The bus voltage Vbus can be, for example, the output voltage of a PFC circuit (not illustrated here). The actuation signals for the clocking of the switches S1, S2 can be generated in a known manner by the switch control unit. The higher-potential switch S1 is controlled by the signal ctrl HS, and the lower-potential switch S2 is controlled by the signal ctrl LS.

In the example illustrated, a resonant circuit, in this case in the form of a series resonant circuit, namely an LLC resonant circuit 22, follows the center point 21 of the inverter 10. In the example illustrated, this resonant circuit 22 has a first inductance Lsigma, a primary winding of the transformer T and a capacitor Cres.

The primary winding of the transformer T in this case has a parallel inductance Lm, which conducts the magnetization current.

The transformer T is followed by a load Load, to which a supply voltage which has been stepped down in comparison with the bus voltage Vbus can be fed. In accordance with the exemplary embodiments in FIG. 1, for example, the load comprises the LED module 3. In addition, elements (not shown) for smoothing and stabilizing the output voltage can be provided at the output of the transformer T.

In FIG. 13, the resonant circuit 22 is in the form of a series resonant circuit. Alternatively, the invention can likewise also be used for other resonant circuits such as parallel resonant circuits, for example. The resonant circuit according to the invention can be correspondingly in the form of a parallel resonant circuit, in which the resonant capacitor Cres is connected in parallel with the load and namely in parallel with the primary winding of the transformer T.

The combination of the inverter 20 with the resonant circuit 22 forms a DC-to-DC converter which is isolating owing to the transformer T as energy-transmitting LED converter.

The switches S1, S2 of the inverter 20 are preferably operated in the vicinity of the resonant frequency of the resonant circuit or in the vicinity of a harmonic of a resonance of the output circuit. The output voltage or the output current of the resonant converter or of the galvanic decoupling F is a function of the frequency of the actuation of the switches S1, S2 of the inverter 20, in this case in the form of a half-bridge inverter.

The LED converter 10 is operated in a specific mode, for example in a fixed-frequency mode or else as a current source or voltage source, in a starting phase, for example in order to identify a load change and therefore read information from the circuit 4 which is transmitted in accordance with at least one protocol, for example.

The circuit 4 can also have a digital control unit IC1, which is configured to output different types of modulated signals, for example also a specific pulse train as digital coding (sequence of zeros and ones), as a preferably modulated load change. The LED converter 10 can be configured to call up different types of information, owing to a change in the supply voltage, i.e. different operational parameters and/or maintenance parameters from the LED module 1 and also to selectively call up one of a plurality of LED modules. The change in the supply voltage can take place, for example, by means of a low frequency (in the range of a few hertz to one kilohertz) or high-frequency modulation (in the range of several tens of kilohertz or a hundred kilohertz or up to the megahertz range).

The digital control unit IC1 of the circuit 4 can be in the form of an integrated circuit. For example, the integrated circuit can be in the form of an integrated control circuit comprising only three or four connections.

Figure 9:
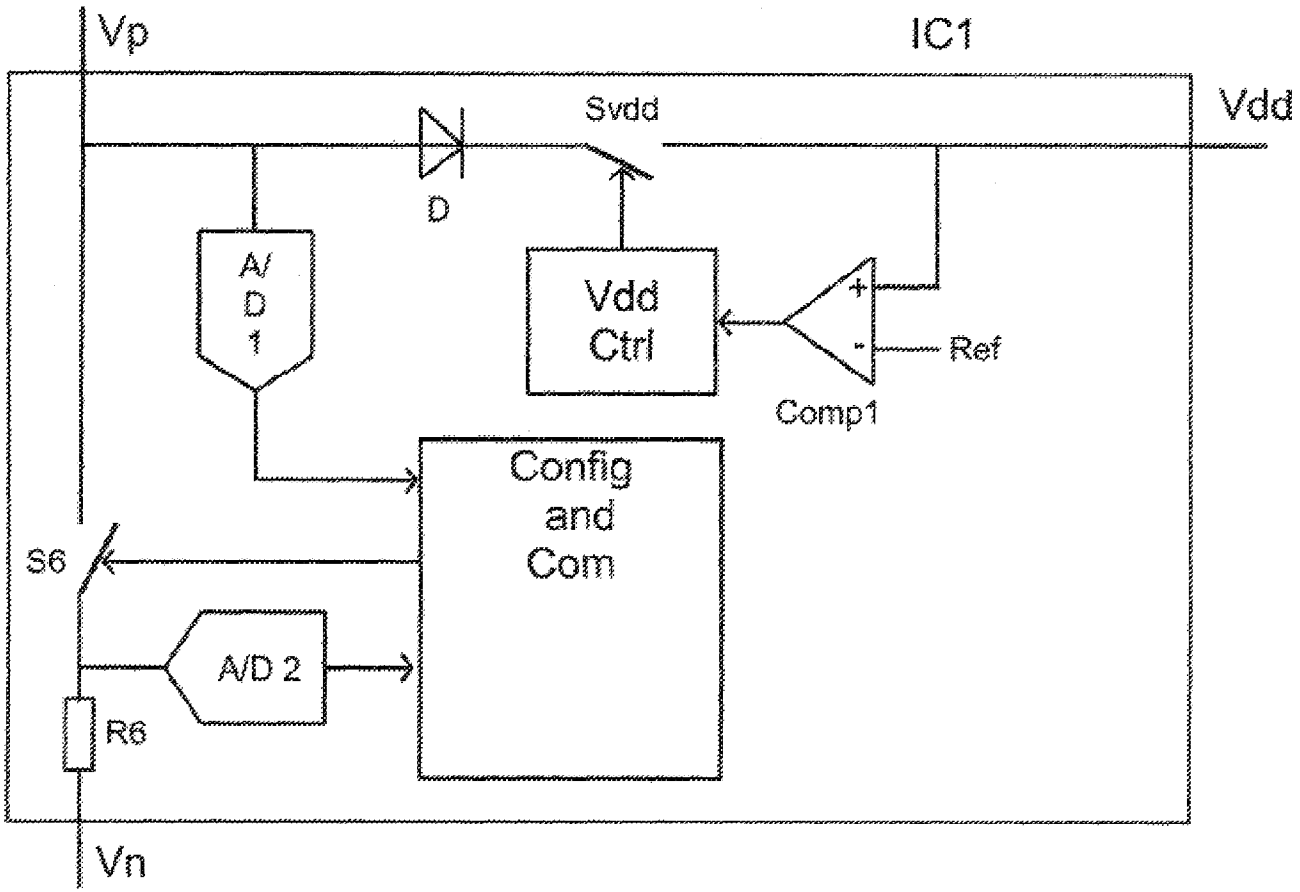
FIG. 9 shows a further example of the circuit on the LED module according to the invention.

In one embodiment comprising three connections, the digital control unit IC1 would have a first connection Vp, which is connected to the supply voltage of the LED module 1 (FIG. 9). The digital control unit IC1 can detect the supply voltage of the LED module 1 by means of the first analog-to-digital converter A/D1 corrected to this first connection Vp via this first connection Vp. A second connection Vn is connected to the ground of the LED module 1 and enables an internal connection to ground within the digital control unit IC1. A third connection Vdd can be connected to a capacitor, which is connected with its other connection likewise to ground of the LED module 1. The second connection Vp can be connected internally to the first connection Vp via a diode and a switch Svdd. This switch Svdd can be compared depending on a comparison of the voltage present at that time at the connection Vdd with a reference value Ref by means of a comparator Comp1. Depending on the comparison result, the switch Svdd can be switched on by the driver unit VddCtrl when the actual value of the voltage at the connection Vdd is less than the reference value Ref. Then, a current flows into the capacitor via the switch Svdd, which capacitor is connected to the third connection Vdd. The voltage present at the third connection Vdd can be used as internal voltage supply for the digital control unit IC1. The connection Vdd is in this case used for stabilizing the internal voltage supply to the digital control unit IC1.

In accordance with this example, the digital control unit IC1 can be programmed in advance, for example during manufacture or fitting of the LED module 1. This programming of the digital control unit IC1 can preset, for example, an operational parameter of the LED module 1, such as the setpoint current or the setpoint voltage, for example.

A switching element S6 is integrated in the digital control unit IC1, said switching element corresponding in terms of function to the switch 6 in the example in FIG. 1 and being configured to output at least one modulated signal or else different types of modulated signals, preferably as modulated load change. In this case, the voltage at the first connection Vp is connected to the second connection Vn directly or indirectly, for example via an integrated resistor R6, internally by closing the integrated switching element S6 and therefore draws the voltage at the connection Vp to a lower potential. For example, the modulated signal can be a specific pulse train and can be output as digital coding (sequence of zeros and ones). The digital control unit IC1 can therefore transmit information, for example, in a runup phase (i.e. a temporally limited starting phase of the LED converter and LED module 1) by means of the switching element S6, preferably in accordance with the at least one protocol which is stored, for example, in the LED module 1 and in the LED converter 10. The current through the switching element S6 can be monitored by means of the resistor R6, wherein the switching element S6 can be opened when the current through the switching element S6 and therefore the resistance of the resistor R6 becomes too great. The detection of the voltage drop across the resistor R6 and therefore of the current flowing through said resistor can take place by means of a second analog-to-digital converter (A/D2). The reading and evaluation of the two analog-to-digital converters and the actuation of the switching element S6 can take place by a control block "Config and Com" integrated in the digital control unit IC1. All further operations such as signal evaluations and outputs can also be implemented by this control block.

A sensor system for detecting the temperature can also be integrated in the digital control unit IC1, for example, as a result of which the digital control unit IC1 can transmit, as maintenance parameter, an excess temperature or an operating temperature as information in accordance with the at least one protocol to the LED converter. As maintenance parameter, the digital control unit IC1 can also have, for example, a counter for the operating time, and the digital control unit IC1 can be configured to output an aging parameter of the LED module or the LED string or an operating duration of the LED module as maintenance parameter. The digital control unit IC1 can also detect an overvoltage at the LED module 1 and output a corresponding error message as maintenance parameter. Optionally or alternatively, the LED string of the LED module 1 can be bypassed by closing the switching element S6 and therefore protected from the overvoltage.

The digital control unit IC1 can also be connected to one or more sensors, for example, and/or one or more sensors can be integrated in the digital control unit IC1. For example, such a sensor system can be formed by a sensor such as a light sensor, a temperature sensor, a color sensor and/or a presence sensor. The digital control unit IC1 can be configured in such a way that it can also supply power to and read the sensor when the LED converter 10 outputs a reduced supply voltage to the LED module 1 and the LED string is not active. The LED converter 10 can supply power to the sensor in an operating mode when the LED string is not active by virtue of the LED converter 10 outputting a reduced supply voltage to the LED module 1.

The circuit 4, in particular the digital control unit IC1, can be configured in such a way that when the supply voltage is within a readout window (i.e. the supply voltage is not equal to zero but is below the forward voltage of the LED string), it represents a variable-current load in said readout window, which variable-current load effects a change in the power consumption of the LED module 1 in accordance with at least one preset protocol. In addition or as an alternative, direct information can also be transmitted from a sensor by the digital control unit IC1 in accordance with at least one preset protocol to the LED converter 10. Thus, for example, an identified presence or a drop in the ambient luminosity can be identified by the digital control unit IC1 with the aid of a sensor, and can be transmitted correspondingly to the LED converter 10 with the aid of a transmission of the load change produced by the circuit 4, with the result that said LED converter 10 can respond correspondingly and increases the supply voltage, for example, with the result that a second supply voltage which is not equal to zero is present at the LED module, at which voltage a connected LED string is conducting.

Thus, a system can be constructed which comprises an LED converter 10 and an LED module 1 supplied by said LED converter and comprising a circuit 4 having a digital control unit IC1 and comprising at least one sensor, wherein the digital control unit IC1 can transmit information from the sensor to the LED converter 10 by a load change. For example, in a so-called standby mode, the connected LED string can be deactivated by virtue of the supply voltage output by the LED converter 10 being reduced to a low value, i.e. below a second supply voltage which is not equal to zero, at which voltage a connected LED string is conducting. In this case, it would also be possible for the LED converter 10 to apply the first supply voltage which is unequal to zero and at which a connected LED string is non-conducting temporally one after the other repeatedly. In this time window of the temporally applied first supply voltage, the digital control unit IC1 can be activated and the at least one sensor can be read.

Irrespective of whether and which information has been detected by the sensor, the digital control unit IC1 can then effect a load change. This load change can be detected and evaluated by the LED converter 10. In this way, information can be transmitted from a sensor in accordance with at least one preset protocol to the LED converter 10 from the LED module 1 by means of the digital control unit IC1. Since the LED converter 10, as already explained, can be configured to identify a load change as information transmission from the LED module 1 when a first supply voltage which is unequal to zero is output, in this way a complex lighting system comprising an LED converter and an LED module incorporating sensors can be constructed in a very simple manner.

Preferably, in this case the transmission of the information from the LED module 1 to the LED converter 10 takes place in accordance with at least one preset protocol. The LED converter can be configured to receive at least one item of information from a sensor from the digital control unit IC1 as at least one determined operational and/or maintenance parameter. The information from a sensor can in this case be used for setting or regulating the operation of the LED module 1. The information from a sensor can also be stored in an assigned memory, displayed optically and/or acoustically and/or transmitted from the LED converter 10 via a wireless or wired interface, possibly upon external request.

Figure 10:
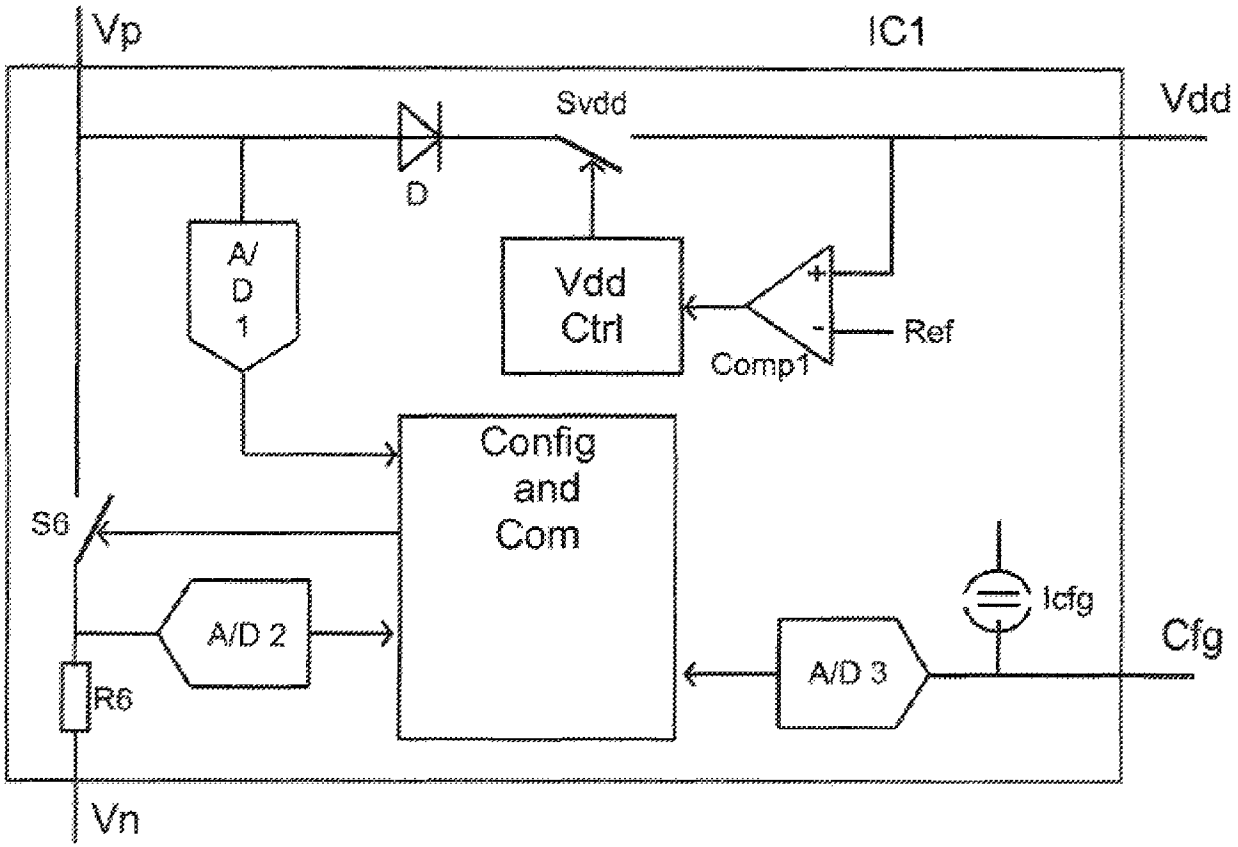
FIG. 10 shows a further example of the circuit on the LED module according to the invention.

FIG. 10 illustrates an embodiment of the digital control unit IC1 comprising four connections. The digital control unit IC1 has a fourth connection Cfg, to which a configuration element such as a resistor Rcfg (selecting resistor R11) can be connected, for example. A controllable current source Icfg can be connected internally to this fourth connection Cfg. The voltage drop across the resistor Rcfg, which voltage drop results from the current fed in by the controllable current source Icfg and the resistance value of the resistor Rcfg, can be detected by the control block "Config and Com" of the digital control unit IC1 via a third analog-to-digital converter A/D3. This detected voltage at the fourth connection Cfg can preset an operational parameter of the LED module 1, such as the setpoint current or the setpoint voltage, for example. Optionally, a temperature-dependent resistor can also be arranged between the fourth connection Cfg and the third connection Vdd, for example. The temperature-dependent resistor can be configured in such a way that its resistance changes significantly in the event of an excess temperature on the LED module 1, as a result of which the voltage at the fourth connection Cfg also changes. This change can be detected by the digital control unit IC1 and an excess temperature as information can be transmitted, for example as maintenance parameter, in accordance with the at least one protocol to the LED converter. For example, an NTC can be used as the temperature-dependent resistor, which NTC decreases its resistance at an excessively high temperature, as a result of which the voltage at the fourth connection Cfg increases. The controllable current source Icfg can be active, for example, only during starting of the digital control unit IC1 in order to read the value of the resistor R11, while, during continuous operation of the LED module 1, only the voltage resulting across the voltage divider from the temperature-dependent resistor and the resistor R11 is monitored in order to identify an excess temperature.

Figure 11:
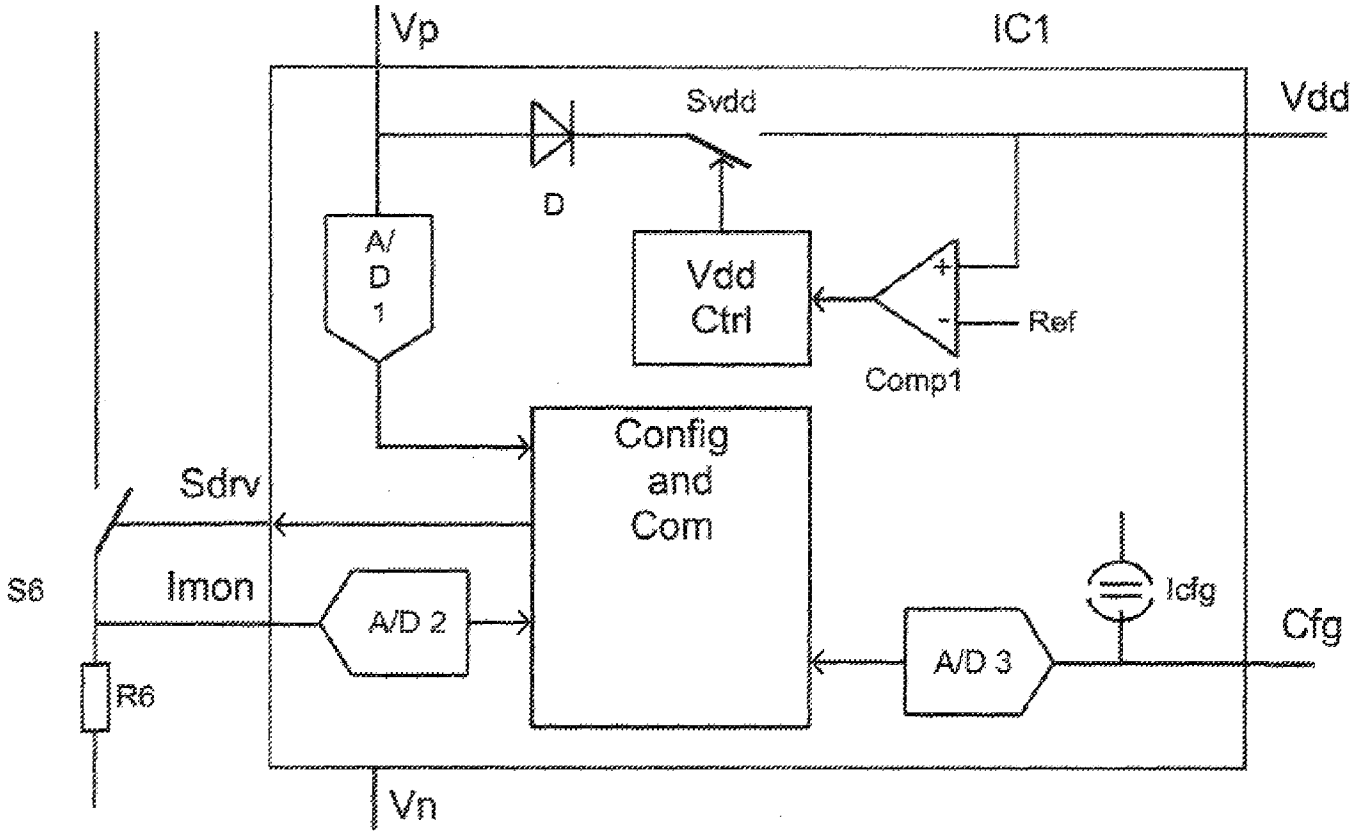
FIG. 11 shows a further example of the circuit on the LED module according to the invention.

In contrast to the examples in FIGS. 9 and 10, in this variant shown in FIG. 11 the switch is not in the form of an integrated switching element S6 but in the form of an external switch 6 analogously to the example in FIG. 1. This switch 6 is actuated by the digital control unit IC1 via a fifth connection Sdrv. A resistor R6 is arranged in series with the switch 6. The current through the resistor R6 can be detected and monitored on the basis of the voltage drop across the resistor R6 by means of a sixth connection Imon by the digital control unit IC1.

Figure 12:
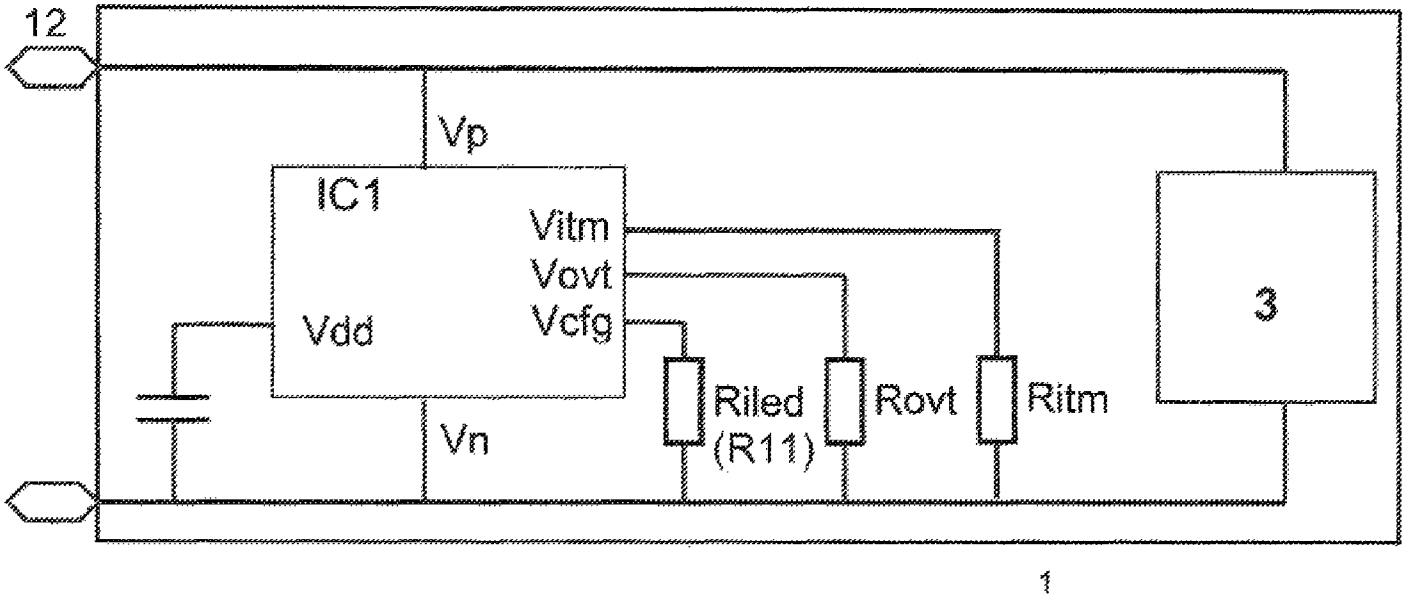
FIG. 12 shows a further example of the circuit on the LED module according to the invention.

The example in FIG. 12 shows a further configuration of the digital control unit IC1. This example has the connections Vp, Vn and Vdd, as does the example in FIG. 10. The fourth connection Cfg is also provided, to which, in turn, a resistor R11 (Riled) is connected as configuration element. Furthermore, the digital control unit IC1 has two further connections. A resistor Rovt, which is a temperature-dependent resistor, is connected to a further connection Vovt. By monitoring the resistance value of this resistor Rovt, an excess temperature can be identified. For this purpose, a further controllable current source can be arranged in the digital control unit IC1, which further controllable current source outputs a current at the further connection Vovt which flows into the resistor Rovt. Depending on the present resistance value which is being monitored on the basis of the detected voltage at this connection Vovt, the digital control unit IC1 can decide upon an excess temperature on the LED module 1. Similarly, a current can be fed into the temperature-dependent resistor Ritm connected to the further connection Vitm via a further controllable current source at said further connection Vitm, and it is possible for the digital control unit IC1 to decide upon the operating temperature on the LED module 1 from the present resistance value, which is monitored on the basis of the detected voltage at this connection Vitm. Depending on the value of the detected operating temperature, this can be transmitted as information precisely in the same way as an excess temperature as information in accordance with the at least one protocol to the LED converter. The information on the operating temperature can be evaluated by the LED converter, wherein intelligent feedback of the current by the LED module 1 can take place without an excess temperature needing to be reached.

The switch 6 and the switching element S6 can perform further functions on the LED module 1 which can be controlled by the digital control unit IC1. Thus, for example, afterglow protection can be made possible. The digital control unit IC1 can identify, for example, when the LED module 1 is intended to be disconnected or has already been disconnected by disconnection of the supply voltage. In order to avoid voltages which are coupled in as a result of parasitic effects or residual charges, the switch 6 or the switching element S6 can be closed in order to avoid partial discharge of the LED owing to the coupled-in voltages. As an alternative or in addition, protection of the LED module 1 from overvoltages can also be made possible by virtue of the switch 6 or the switching element S6 being closed at least temporarily in the event of an overvoltage at the supply input of the LED module 1 in order to decay the overvoltage or to protect the LED. Thus, protection against overvoltages can also be made possible on disconnection of the LED module 1 from the LED converter during operation of the LED module 1, as so-called "hot-plug" protection. Such a disconnection can occur both in an undesired manner as a result of a sudden contact interruption in the supply line or else as a result of user error by intervention, such as, for example, a changeover of the LED module 1 during operation.

The LED converter 10 can, owing to selective change in the supply voltage for the LED module 1, effect a changeover of the LED module to a communications mode, and then the LED converter 10 can detect the change in the power consumption of the LED module 1 and, in accordance with the at least one protocol which is stored in the LED module 1 and in the LED converter 10, for example, decode said change. For example, the LED converter 10 can thus call up various information from the LED module 1, wherein a specific protocol can be stored for each request. Thus, without any additional lines or pins, a bidirectional communications path between the LED module and the LED converter is made possible.

The change in the power consumption of the LED module 1 can be effected depending on a value of the first supply voltage 5*a* in accordance with one of a plurality of preset protocols and therefore a different load change can be effected in accordance with one of a plurality of preset protocols.

Three concepts for detecting the change in the power consumption of the LED module 1 by the LED converter 10 are preferred in the present invention. Firstly, the determination of a constant-current load, wherein the constant current can be measured, for example, via a discharge rate of a capacitor at the LED converter 10. Secondly, by determination of a frequency of the change in the power consumption of the LED module 1, for example by direct detection of the current on the converter side. And finally by indirect detection by means of determining a peak current within the LED converter, which has an isolated flyback converter or buck converter, for example, which is measured across a shunt. The peak current follows the change in the power consumption of the LED module 1.

By way of summary, the present invention proposes transmitting information from an LED module 1 to an LED converter 10 which makes it possible to decide upon operational and/or maintenance parameters to be set at the LED module 1. The operational parameter to be set may be, for example, the setpoint current or the setpoint voltage. For this purpose, in accordance with the invention, a circuit 4 (load modulation circuit) is provided on the LED module, which circuit represents a load for the LED converter, for example in a voltage range of a first supply voltage 5*a* which is not equal to zero and at which an LED string 3 connected to the LED module 1 is non-conducting, and represents no load for the LED converter 10 in a voltage range of a second supply voltage 5*b* which is not equal to zero and at which a connected LED string 3 is conducting. The voltage 4 can also be activated only temporally, preferably only during a starting phase of the LED luminaire. The load can be constantly or repeatedly variable (modulated), for example in accordance with a preset protocol. A modulated load change can take place, for example, in accordance with a preset protocol, for example. The power consumption can be detected by the LED converter 10, in particular even a change in the power consumption (amplitude, frequency, duty factor). As a result, the LED converter 10 can determine the operational and/or maintenance parameters. The transmission of this information between the LED module 1 and the LED converter 10 does not require any additional connections (only the connection of the supply voltage). In addition, no interaction with the LED module 1 and/or LED converter 10 is required. As a result, the disadvantages of the known prior art are improved.

What is claimed is:

1. An LED module (1) comprising:

connections (2) for an LED string (3);

a circuit (4), which is configured to constitute a load when a constant current or a constant voltage is applied to the LED module (1) in a starting phase, and which is configured to constitute no load when the starting phase has elapsed, and an LED converter comprising a converter with high-speed clocking having a transformer, the converter with high-speed clocking being operated at least in the starting phase as constant current source and is configured:

to detect a power consumption of the LED module (1) on a primary side of the transformer during said starting phase, and to determine, on the basis of the detected power consumption, at least one of: an operational or a maintenance parameter of the LED module (1), wherein the circuit (4) is configured to constitute a variable-current load, which effects a change in the power consumption of the LED module (1) in accordance with at least one preset protocol.

2. The LED module (1) as claimed in claim 1, wherein the circuit (4) is configured to code at least one operational and/or maintenance parameter of the LED module (1) by the change in the power consumption in accordance with the at least one preset protocol.

3. The LED module (1) as claimed in claim 1, wherein the at least one preset protocol presets a frequency and/or an amplitude and/or a duty factor for the change in the power consumption of the LED module (1).

4. The LED module (1) as claimed in claim 1, wherein the circuit (4) is configured in such a way that the change in the power consumption of the LED module (1) is effected depending on a value of the first supply voltage (5*a*) in accordance with one of a plurality of preset protocols.

5. The LED module (1) as claimed in claim 1, wherein the circuit (4) comprises a timer circuit (6), which is configured to preset a frequency of the change in the power consumption of the LED module (1).

6. The LED module (1) as claimed in claim 1, wherein at least one sensor is provided on the LED module (1), said sensor is configured to influence an electrical parameter of the circuit (4).

7. The LED module (1) as claimed in claim 6, wherein the at least one sensor is a light sensor having a light-dependent resistor, and the light sensor is connected to the circuit (4) in such a way that a change in the light-dependent resistor changes the load resistance of the circuit (4).

8. The LED module (1) as claimed in claim 1, wherein the LED converter (10) is configured:

to use the at least one determined operational or maintenance parameter for setting or regulating the operation of the LED module (1), to store said operational or maintenance parameter in an assigned memory, to display said operational or maintenance parameter optically or acoustically or to transmit said operational or maintenance parameter via a wireless or wired interface.

9. The LED module (1) as claimed in claim 1, wherein the at least one operational and/or maintenance parameter is a setpoint current through an LED string (3) connected to the LED module (1), an aging parameter, an operating duration and/or a spectrum of a light emitted by the LED string (3).

10. The LED module (1) as claimed in claim 1, wherein the LED converter (10) is configured to identify the LED module (1) on the basis of the at least one determined operational and/or maintenance parameter.

11. The LED module (1) as claimed in claim 1, wherein the LED converter (10) is configured to changeover selectively between a mode for detecting a power consumption of the LED module (1) and a mode for lighting operation of an LED string (3) connected to the LED module (1) by setting a first supply current or a second supply current for the LED module (1).

12. The LED module (1) as claimed in claim 1, wherein the LED converter (10) is configured to perform a voltage measurement for directly detecting the power consumption of the LED module (1).

13. The LED module (1) as claimed in claim 1, wherein the LED converter (10) is configured to perform indirect detection of the power consumption of the LED module (1).

14. The LED module (1) as claimed in claim 1, wherein the LED converter (10) is configured to detect a change in the power consumption of the LED module (1) as a result of a change in a duty factor for clocking of the LED converter (10).

15. The LED module (1) as claimed in claim 1, wherein the LED converter (10) is configured to discharge a capacitor (11) via a load of the LED module (1), to determine a discharge current of the capacitor (11) directly, or indirectly via a discharge time, and to determine the at least one operational and/or maintenance parameter of the LED module (1) on the basis of said discharge current.

16. An LED luminaire, comprising an LED module (1) having:

connections (2) for an LED string (3);

a circuit (4), which is configured to constitute a load, when a constant current or a constant voltage is applied to the LED module (1) in a starting phase, and which is configured to constitute no load when the starting phase has elapsed, wherein the circuit (4) is configured to constitute a variable-current load, which effects a change in the power consumption of the LED module (1) in accordance with at least one preset protocol; and an LED converter (10) comprising a converter with high-speed clocking having a transformer, the converter with high-speed clocking being operated at least in the starting phase as constant current source and is configured:

to detect a power consumption of the LED module (1) on a primary side of the transformer during said starting phase, and to determine, on the basis of the detected power consumption, at least one of an operational or a maintenance parameter of the LED module (1).

* * * * *